United States Patent [19]

Matsunaga et al.

[11] Patent Number: 4,886,966

[45] Date of Patent: Dec. 12, 1989

[54] APPARATUS FOR INTRODUCING SAMPLES INTO AN INDUCTIVELY COUPLED, PLASMA SOURCE MASS SPECTROMETER

[75] Inventors: Hideki Matsunaga, Yokohama; Naoyuki Hirate, Yokosuka, both of Japan

[73] Assignee: Kabushiki Kaisha Toshiba, Kawasaki, Japan

[21] Appl. No.: 293,667

[22] Filed: Jan. 5, 1989

[30] Foreign Application Priority Data

Jan. 7, 1988 [JP] Japan ..... 63-1657
Mar. 18, 1988 [JP] Japan ..... 63-63466
Jun. 24, 1988 [JP] Japan ..... 63-156463

[51] Int. Cl.[4] ..... H01J 49/00

[52] U.S. Cl. ..... 250/288; 250/281; 250/423 R; 313/362.1; 315/111.11; 315/111.81

[58] Field of Search ..... 250/281, 288, 282, 423 R, 250/424, 425; 313/564, 362.1, 231.31; 315/111.11, 111.81

[56] References Cited

U.S. PATENT DOCUMENTS 4,156,814 5/1979 Hunt et al. ..... 250/288
4,682,026 7/1987 Douglas ..... 250/288

FOREIGN PATENT DOCUMENTS 0082648 4/1986 Japan ..... 250/281

OTHER PUBLICATIONS

Analytical Chemistry, vol. 59, P2191–2196; C. J. Park, J. C. Van Loon, P. Arrowsmith, J. B. French; 1987.
Applied Spectroscopy, vol. 39, No. 4, P719–726; Kin C. Ng, Joseph A. Caruso; 1985.
Furnace Atomic Absorption Spectrometry, P34–43, Japan Scientific Societies Press; Tsutomu Takahashi, Hidehiro Daidoji; 1984.

*Primary Examiner*—Carolyn E. Fields
*Assistant Examiner*—John A. Miller
*Attorney, Agent, or Firm*—Oblon, Spivak, McClelland, Maier & Neustadt

[57] ABSTRACT

A sample introducing apparatus for an inductively coupled plasma mass spectrometer comprises a means supplying the inert gas for carrying the vaporized sample, a heater for defining the path through which the inert gas is passed as well as having the inner surface, on which the sample to be analyzed thereon is put and for generating the heat with the electrical being applied, in which the film structure is formed on said surface, and the surface contacted with the inert gas of the film structure vaporized the sample made of any one of the high melting metal oxide and the high melting metal nitride, an electrode structure for supporting the heater and supplying the electrical power to the heater.

51 Claims, 3 Drawing Sheets

APPARATUS FOR INTRODUCING SAMPLES INTO AN INDUCTIVELY COUPLED, PLASMA SOURCE MASS SPECTROMETER

BACKGROUND OF THE INVENTION

1. Field of the Invention

The present invention relates to an apparatus for introducing samples into a mass spectrometer, and more particularly to an apparatus for introducing samples into an inductively coupled plasma source mass spectrometer, thereby to measure the amount of uranium or thorium contained in semiconductor materials.

2. Description of the Related Art

If semiconductor material for manufacturing a memory (e.g., a dynamic memory) contains uranium (U) or thorium (Th), the radioactive element will emits rays as it undergoes spontaneous decay, inevitably causing software errors in the cells of the memory. In order to make a high-speed memory of a high integration density and a great storage capacity, the semiconductor material (e.g., packaging material and chip material) preferably contains as little U or Th as possible.

Among the known methods of measuring the content of U or Th in semiconductor materials are:

(1) Inductively coupled plasma emission spectrometry (2) Fluorescence spectrometry (3) Radio-activation analysis The first two methods cannot measure an extremely small amount of U or Th contained in the samples. Besides, they cannot be used in practice where the samples have been subjected to complex chemical pre-treatment. These methods inevitably require a long time to analyze the samples. The last method, i.e., radio-activation analysis, is generally employed to measure the content of U or Th in semiconductor materials, but is not practical since it needs the assistance of a nuclear reactor.

Recently, an inductively coupled plasma source mass spectrometer has been used in an attempt to analyze U or Th, instead of any of the three methods mentioned above. This new method is disclosed in Rober S. Houk et al. *Inductively Coupled Argon Plasma as an Ion Source for* Mass Spectrometric Determination of Trace Elements, Anal. Chem., Vol. 52, pp 2283–2289, 1980, Alan R. Date et al., *Plasma Source Mass Sepectrometry Using an Inductively coupled plasma and High Resolution Quadrupole Mass Filter*, Vol. 106, 1255–1267, 1981 and U.S. Pat. No. 4,501,965, Donald J. Douglas. As these publications teach, the inductively coupled plasma mass spectrometry is carried out in the following way. First, a dissolved sample is made misty by a nebulizer. Next, the misty sample is introduced into the inductively coupled plasma, and changed into excited ions. These ions are mass-separated by means of a quadruple mass filter, whereby the content of U or Th in the sample is measured by electron multiplier.

The inductively coupled plasma mass spectrometry can provide more accurate results than the inductively coupled plasma emission spectrometry or fluorescence spectrometry. However, this method is disadvantageous in two respects. First, the samples cannot be introduced into the plasma with high efficiency. Second, the detection accuracy is limited to $10^{-11}$ g to $10^{-12}$ g., and the method cannot practically apply to a small sample such as thin semiconductor film.

It has been proposed that an apparatus, which vaporizes samples, thereby to introduce the samples into a inductively coupled plasma mass spectrometer with an increased efficiency, be mounted on the mass spectrometer. In such an apparatus, a sample is placed on the heat-generating plate of a heater. The sample is heated gradually by the heater in an inert gas flow. The sample is heated, and the target element, U or Th, vaporizes. The heat-generating plate is made of a material having a high-melting point, such as graphite, tantalum, or tungsten.

When the plate is made of graphite, U or Th contained in the vaporized sample reacts with graphite, inevitably forming carbide. Consequently, the efficiency of ionization of U or Th decreases, or U or Th remains in the heat-generating plate to cause so-called "memory effect." Either insufficient ionization or the memory effect greatly reduces the accuracy of measuring the U content or the Th content.

On the other hand, when the plate is made of tantalum or tungsten, the U or Th, which is an impurity contained in the metal in a very small amount, is detected along with the U or Th contained in the sample. In this case, it is difficult to analyze the U or Th contained in the sample when the U or Th content of the sample is less than the U or Th content of the metal.

SUMMARY OF THE INVENTION

An object of the present invention is to provide an apparatus for introducing samples, with high efficiency, into an inductively coupled plasma mass spectrometer, allowing neither U nor Th contained in the apparatus to mix with the samples being introduced into the mass spectrometer.

Another object of the invention is to provide an apparatus for introducing samples into an inductively coupled plasma mass spectrometer, with high efficiency so that the mass spectrometer can detect U or Th contained in each sample in a small amount, with high accuracy at high speed.

According to the invention, there is provided an apparatus for vaporizing a sample and introducing the vaporized sample into an inductively coupled plasma source mass spectrometer, comprising:

means for supplying an inert gas which transfers the vaporized sample;

a heater for generating a heat with an electrical power, which is provided with a film structure having the inner surface for defining a path through which the inert gas is passed and on which the sample is to be located, the film structure including a material for forming the inner surface, and essentially consisting of one selected from the group consisting of a metal oxide and a nitride; and an electrode structure for supporting the heater and supplying the electrical power to the heater.

Further, according to the present invention, there is provided a sample analyzing apparatus comprising:

a means supplying an inert gas for carrying a vaporized sample;

a heater for generating a heat with an electrical power, which is provided with a film structure having an inner surface for defining a path through which the inert gas is passed and on which the sample is to be located, the film structure includes a material for forming the inner surface, and essentially consisting of one selected from the group consisting of metal oxide and metal nitride;

an electrode structure for supporting the heater and supplying the electrical power to the heater;

a means for ionizing the vapored sample with a plasma into excited sample ions;

a means for introducing the sample ions; and a means for mass-separating the introduced sample ions and detecting the intensity of the introduced ions.

DETAILED DESCRIPTION OF THE PREFERRED EMBODIMENTS

Figure 1:
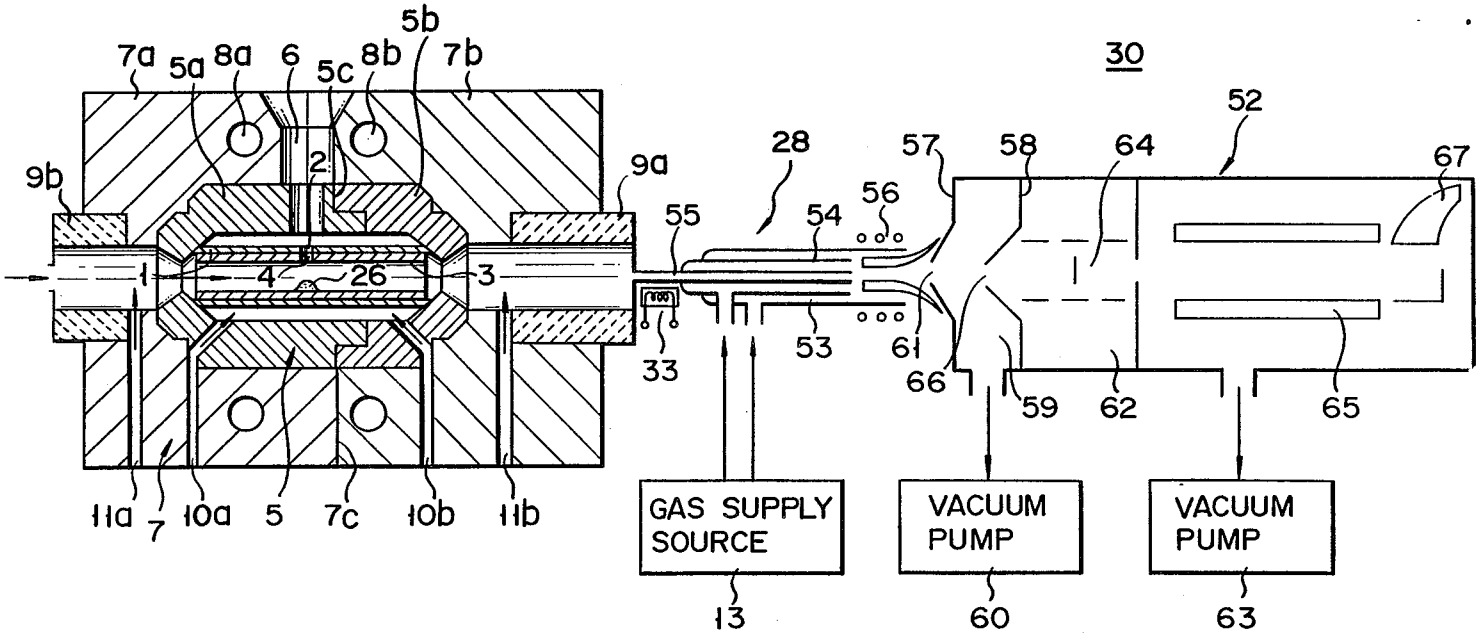
FIG. 1 is a schematical view illustrating a system comprising an inductively coupled plasma mass spectrometer and an apparatus for introducing samples into the inductive coupled plasma mass spectrometer, said apparatus being one embodiment of the present invention.

FIG. 1 schematically illustrates an analyzing system provided with an inductively coupled plasma mass spectrometer and an apparatus for introducing the samples into the inductively coupled plasma mass spectrometer. The sample-introducing apparatus is embodiment of the present invention.

Figure 2:
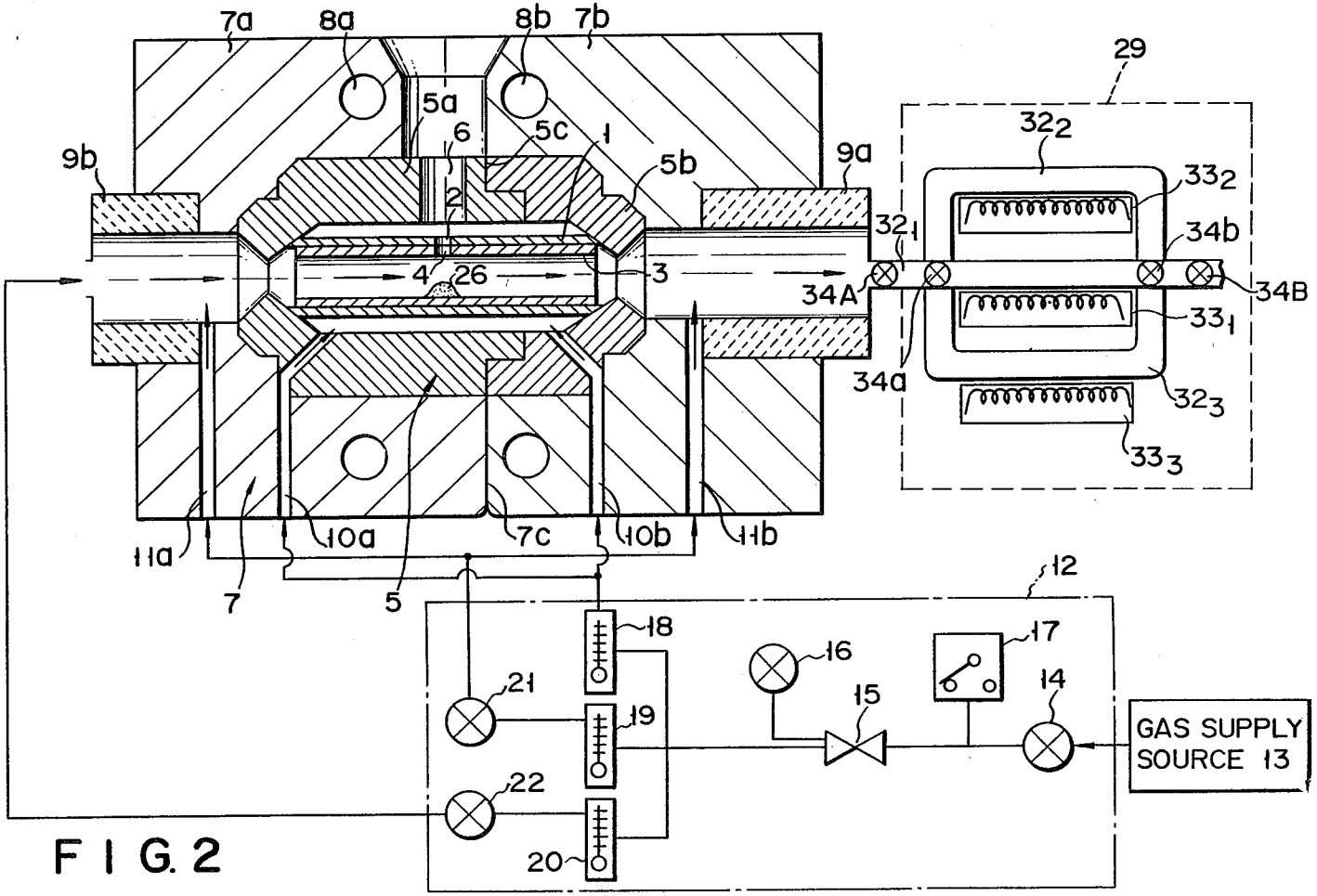
FIG. 2 is an enlarged view of the sample-introducing apparatus shown in FIG. 1.

FIG. 2 is an enlarged view of the sample-introducing apparatus. As is shown in FIGS. 1 and 2, the apparatus has cuvette 1. Cuvette 1 is made of a heat-generating material such as graphite. It has, in its middle portion, hole 2 through which to introduce a sample into cuvette 1. Tube 3 made of a metal having a high melting point is mounted on cuvette 1. It has hole 4 which is coaxial with hole 2 of cuvette 1. Hence, the sample can be introduced into cuvette 1 through these holes 4 and 2. Cuvette 1 and tube 3 are placed within hollow cylindrical electrode assembly 5 consisting of pair of electrodes 5*a* and 5*b* which are also hollow cylinders. Electrodes 5*a* and 5*b* can be moved away from each other, in their axial direction. Cuvette 1 has both ends fixed to the inner surfaces of electrodes 5*a* and 5*b*, respectively. Electrode 5*a* has hole 6 into which to insert a pipe. Insulating layer 5*c* is interposed between electrodes 5*a* and 5*b*, thus electrically insulating electrode 5*a* from electrode 5*b*.

Electrode assembly 5 is held within hollow cylindrical electrode structure 7 consisting of electrode blocks 7*a* and 7*b* coupled to each other. Both blocks 7*a* and 7*b* are made of good electric conductor. Insulating layer 7*c* is interposed between electrode blocks 7*a* and 7*b*, thus electrically insulating block 7*a* from block 7*b*.

Figure 3:
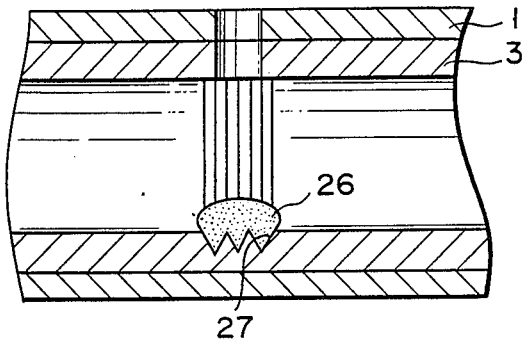
FIG. 3 is a enlarged cross-sectional view showing the cuvette and the tube, both used in the apparatus of FIG. 2.

Cuvette 1, assembly 5, and structure 7 are made of a good electric conductor which remains intact at a temperature ranging from 2600 to 3000° C. More specifically, they can be made of graphite, tantalum, tungsten, radium, zirconium, or the like. According to the invention only cuvette 1 or only tube 3 may be placed within electrode assembly 5. No mater whether cuvette 1 or tube 3, or both (as is shown in FIG. 2) are placed within electrode assembly 5, parallel annular grooves 27 are made in the inner surface of that portion of cuvette 1 or tube 3, or both, which have holes 2 and 4, as is illustrated in FIG. 3. These annular grooves 27 prevent sample 26 from moving within cuvette 1 or tube 3, or from flowing therefrom. If sample 26 moves on the inner surface of heated cuvette 1 or tube 3, the condition under which the sample is vaporized changes each analysis is needed, due to the changes of the temperature distribution in heated cuvette 1 or heated tube 3. The changes of the condition do not occur because of grooves 27. That is to say, fine grooves are formed on the circumference near the inner surface of cuvette 1 or near the inner surface of tube 3, whereby part of the sample injected through hole 2 or 4 flows into and stays in grooves 27 by the surface tension. Even when the inert gas is passed through cuvette 1 or tube 3, or even when cuvette 1 or tube 3 is slanted, the sample remains in cuvette 1 or tube 3. As a result, even though the distribution of the temperature is altered in cuvette 1 or tube 3, it is possible to heat and vaporize the sample under the same condition, thus enabling the inductively coupled plasma mass spectrometer to measure the contact of any component of the sample with high accuracy.

To prevent the sample from moving from the middle portion of the inner surface on cuvette 1 or tube 3, it is desirable that the width or depth of grooves 27 be large. However, if it is excessively very large, the cuvette or the tube is easy to break. Therefore, it is practically desirable the that grooves 27 have a width or depth of 1 -10 μm.

Annular grooves 27 are formed by scratching the inner surface of cuvette 1 or tube 3 by means of a jig having a sharp edge and made of a hard material, for example, super-hard alloy, ceramics, glass, etc. In order to form grooves 27, an electron beam or a laser beam can be applied to the inner surface of cuvette 1 or tube 3. Alternatively, grooves 27 can be formed by chemically etching the inner surface of cuvette 1 or tube 3. After forming grooves 27, the inner surface of cuvette 1 or tube 3 is contaminated by the impurities. Due to it, prior to assembling cuvette 1 or tube 3 into the apparatus, the impurities must be removed by washing cuvette 1 or tube 3 with acid or by heating cuvette 1 or tube 3 at, for example, 2600 -3000° C, in a flow of an inert gas such as argon.

As shown in FIG. 1 and FIG. 2, electrode blocks 7*a* and 7*b* have passages 8*a* and 8*b* through which to supply water to cool these blocks 7*a* and 7*b*. In electrode blocks 7*a*, 7*b* there are respectively inserted quartz pipe 9*a* used as the outlet part for the carrier gas such as argon and helium, etc., and quartz pipe 9*b* used as the inlet port for the gas. (A small amount of hydrogen is added to said argon and helium.) These inlet and outlet ports communicate with the flowing path made in electrode structure 7 and electrode assembly 5. Also, in order to supply the carrier gas into the space between cuvette 1 and electrode assembly 5, outer passages 10*a* and 10*b* are formed in electrode structure 7 and electrode assembly 5. Also, inner passages 11*a* and 11*b* are formed in electrodes 7*a* and 7*b* and located near the inserting portions of quartz pipes 9*a* and 9*b* to flow the carrier gas during the drying of the sample in tube 3 and during the vaporizing of the sample.

Cuvette 1, tube 3, electrode assembly 5, and electrode structure 7 constitute a furnace. In this furnace, the surfaces of cuvette 1, tube 3, and electrodes 5*a* and 5*b*, which the heated inert gas or the vaporized sample contact, are coated with metal oxide film or metal nitride film, either having a high melting point. It is preferable that the surfaces of cuvette 1, tube 3, and electrodes 5*a* and 5*b* are coated with coated film of a two-layer structure, consisting of carbide film and oxide film or nitride film (both having a high melting point metal) formed one upon the other. Groove 27 formed in the inner surface of cuvette 1 or tube 3 have a depth less than the thickness of the carbide film, the oxide film or the nitride film, or the coated film thickness of two-layer structure. Grooves 27 are coated so that the ports of cuvette 1 or tube 3 are not exposed. Cuvette 1 is made of graphite and fitted in tube 3. In the case where cuvette 1 and tube 3 are made of a high-melting point metal, they are coated with a metal oxide film or a nitride film having a high melting point, or with film of a two-layer structure, and tube 3 is mounted on cuvette 1 to form the electrode assembly 5.

The metal oxide for the coating of cuvette 1 and electrode 3 is, for example, tantalum oxide, tungsten oxide or zirconium oxide. The metal nitride for the coating of cuvette 1 and tube 3 is, for example, tantalum nitride, tungsten nitride, hafnium nitride, zirconium nitride or titanium nitride.

The metal oxide, the metal nitride, and the two-layer structure must be thick enough to prevent the materials of the electrode and the cuvette from reacting with the vaporized sample and to suppress the vaporization and mixing of the impurity in these materials with the vaporized sample. Therefore their thicknesses must be 1 μm to 10 μm. The metal oxide film and the metal nitride film, either having a high melting point, are formed by CVD, heating oxidation, sputtering deposition, coating-calcination, or the like. Of these methods, the coating-calcination is the best since it is easy with this method to form these films.

As is shown in FIG. 2, the sample-introducing apparatus is provided with gas control mechanism 12 coupled to inert gas supply source 13. Inert gas, for example, the argon or the helium, or a mixture of either gas and a small amount of the hydrogen is supplied to inert gas supply source 13. In gas control mechanism 12, first electronic valve 14 is coupled by an inert gas supplying line to inert gas supply source 13. Valve 14 is also connected to pressure adjusting device 15 for adjusting the pressure of the inert gas. Pressure meter 16 is connected to device 15. Pressure adjusting device 15 and pressure meter 16 are set at the predetermined pressure so that the pressure of the inert gas is properly adjusted. Pressure switch 17 is connected on the insert supplying line connecting electronics valve 14 and pressure adjusting mechanism, to detect whether the pressure of the inert gas introduced into inert gas supply source 13 is sufficient or not. If the pressure which switch 17 has detected is below the predetermined value, a signal is fed back to the power source controllers (not shown) incorporated in electrode blocks 7*a* and 7*b*. These controllers prevent cuvette 1 from being heated to a high temperature, e.g., about 3000° C, and thus being oxidized. The inert gas supply line provided on the front and rear side of pressure adjusting device 15 is branched into three parts, which are coupled to flow meter 18–20 for measuring the flows rate of the carrier gas. First flow meter 18 is connected to outer passages 10*a* and 10*b* of the heating furnace, second flow meter 19 is connected by second electronic valve 21 to inner flowing passages 11*a* and 11*b* of the heating furnace. Third flow meter 20 is connected by third electronic valve 22 to quartz pipe 9*b*, which is the inlet port for supplying the carrier gas into the heating furnace. Fourth and fifth electronic valves 34A and 34B are located in pipe arrangement 29 connecting the heating furnace and the plasma torch 28 of inductively coupled plasma mass spectrometer 30. Between quartz pipe 9*a* and the plasma torch 28 there are parallel connecting tubes $32_1$ to $32_3$ made of a transparent and acid-resistant material. Infrared heaters $33_1$ to $33_3$ surround tubes $32_1$ to $32_3$, respectively. Also, three-way valve 34*a* and 34*b* are provided in the connecting portions of connecting tube $32_1$ to $32_3$, respectively, for changing the paths of the carries gas.

As has been described, infrared heater $33_1$ surrounds connecting tube $32_1$ for supplying the vaporized sample to plasma torch portion 28. Thus, it is easy to heat connecting tube $32_1$, thereby to prevent the vaporized sample gas from condensing or being adsorbed to the inner surface of tube $32_1$. As a result, the target components can be introduced into the plasma torch portion of inductively coupled plasma mass spectrometer 30 with efficiency high enough to eliminate the memory effect. Also, since connecting tube $32_1$ is made of the transparent and acid-resistant material (for example, quartz glass), the adsorption of the sample to connecting tube $32_1$ can be monitored from out. As a result, it is possible to prevent the vaporized sample from being adsorbed at the connecting portion. Also, of tube $32_1$ is shorter than 10 cm, it prevents the vaporized sample from being condensed or adsorbed at connecting tube $32_1$, or from being scattered or diluted.

As has been described, three connecting tubes $32_1$ to $32_3$ are installed parallel to another between quartz pipe 9*a* and the plasma torch portion 28, and three-way valves 34A and 34B are connected on the connecting portions of tubes $32_1$ to $32_3$. Thus, if connecting tube $32_1$ is contaminated by the adsorbed sample gas, valves 34*a* and 34*b* can be operated to flow the sample gas into other connecting tube $32_2$ or outer connecting tube $32_3$. Accordingly, it is unnecessary to remove, wash, connect or adjust tubes $32_1$ to $32_3$ every time the sample is to be analyzed. The analysis of the samples can, therefore, be continuously and easily performed.

The connecting portion between the quarts pipe 9*a* and the plasma torch portion 28 can be made of any material that neither directly nor indirectly disturbs the accuracy of measuring of the components of the sample. However, it is desirable to use materials which are sufficiently resistant to heat and acid, in view of the fact that the sample gas is very hot and contains a corrosive component, such as the hydrogen chloride gas and the nitric acid gas. Also, it is desirable that each connecting portions be made of transparent material in order to detect the adsorption of the sample gas at the connecting portion The material superior in transparent, heat-resistance, and acid-resistance is, for example, quartz (not applicable when the sample gas includes hydrogen fluoride), sapphire, a copolymer of tetrafluoroethylene and hexafluoropropylene, or a copolymer of tetrafluoroethylene and ethylene. Also, the length of the connecting portion must be as short as possible, to minimize the possibility that the vaporized sample is condensed, adsorbed to the connecting portion, scattered, or diluted. Preferably, the connecting portion is shorter than 10 cm. The heating means for heating connecting tube $32_1$ is not limited to infrared heaters 33, they can be heaters using electrical resistance or the other types of heaters. The connecting portion must be heated by these heaters high temperatures, in order to suppress the condensing and adsorption of the vaporized sample at the connecting portion. These temperatures are practically set at 100 to 250° C.

Inductively coupled plasma mass spectrometer 30 comprises plasma torch portion 28 and mass spectrometer 52 shown in FIG. 1. Plasma torch portion 28 has inner tube 54 and thin tube 55 coaxial with tube 54 and extending from pipe arrangement 29. Coil 56, to which a high frequency electrical power is supplied, is wound around plasma tube 53. Plasma tube 53 has holes coaxial with the openings of inner tube 54 and thus tube 55. The inert gas is fed from gas supply source 13 into plasma tube 53 and inner tube 54. Thus, the vaporized sample transferred along with the carrier gas is changed into the plasma generated by means of coil 56. The sample is changed into excited ions in plasma torch portion 28. In mass spectrometer 52 for capturing an ionized trace sample and measuring its mass, first vacuum section 59 defined by first orifice plate 57 and second orifice plate 58 is maintained at the vacuum by means of first vacuum pump 60, and the ions of the sample are introduced through first orifice 61 formed in first orifice plate 57, from the plasma torch into first vacuum section 59. Second vacuum section 62 defined by second orifice plate 58 is maintained in the vacuum state by means of second vacuum pump 63. Ion lens 64 for accelerating the sample ions and quadrupole mass filter 65 for mass-separating the ions are arranged in second vacuum section 62. The ions are introduced from first vacuum section 59 into second vacuum section 62 through first orifice 66 formed in second orifice plate 58, and are then accelerated by ion lens 64. The mass the ions are separated by quadrupole mass filter 65, and changed into electrical signals by electron multiplier 67. The details of inductively coupled plasma mass spectrometer 30 are disclosed in Rober S. Houk et al. *Inductively Coupled Argon Plasma as an Ion Source for Mass Spectrometric Determination of Trace Elements*, Anal. Chem., Vol. 52, pp 2283–2289, 1980, Alan R. Date et al., *Plasma Source Mass Spectrometry Using an Inductively Coupled Plasma and a High Resolution Quadrupole Mass Filter*, in "Analyst," Vol. 106, pp 1255–1267, 1981, and U.S. Pat. No. 4,501,965 to Donald J. Douglas.

The sample-introducing apparatus and the inductively coupled plasma mass spectrometer, both shown in FIGS. 1 and 2 are operated as follows, so that evaporated sample is introduced into the inductively coupled plasma mass spectrometer and analyzed.

Figure 4A:
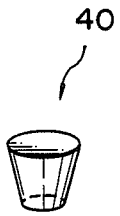
FIG. 4A and FIG. 4B are perspective views showing the cover used in the apparatus shown in FIG. 2 during the analysis of the sample.
Figure 4B:
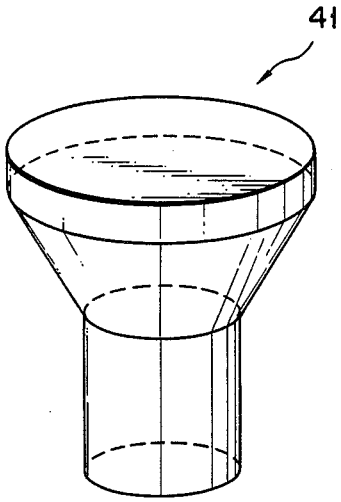

Firstly, a sample is applied from a pipet through holes 6, 2 and 4 into cylindrical tube 3, with second to fourth solenoid valves 21, 22, 34A, 34B closed. Thereafter, power source supplies power to electrode blocks 7*a* and 7*b* in accordance with the heating programming of the control portion (not shown). A voltage is applied across cuvette 1 through electrodes 5*a* and 5*b* connected to electrode blocks 7*a* and 7*b*. As a result, cuvette 1 and tube 3 are heated to the predetermined temperature. Sample 26 in tube 3 is dried and ashed. Meanwhile, second and third electronic valves 21 and 22 are opened, whereby the inert gas is fed into quartz pipe 9*b* and inner flowing passages 11*a* and 11*b* of the furnace. The water vapor and the coexisting materials, emanating from sample 24 being dried and ashed, are removed out of the heating furnace through sample injecting holes 4 and 2 and pipet inserting hole 6, along with the carrier gas. Since electronic valves 34A and 34B closed while sample 26 is being dried and ashed the carrier gas containing water is not supplied to inductively coupled plasma mass spectrometer 30. Then, holes 2, 4 and 6 are closed with a graphite plug, boron nitride plug 40 and a heating-resistant metal plug 41, —all coated with metal oxide film having a high melting point or the nitride film, as is shown in FIG. 4A and FIG. 4B. Thereafter, the current supplied to cuvette 1 is increased. Cuvette 1 is heated to a relatively high temperature, thus vaporizing the target elements from sample 26. When the target element are vaporized, fourth and fifth electronic valves 34A and 34B are opened. The vaporized target elements are introduced into plasma torch apparatus 28 of inductively coupled plasma mass spectrometer 52, and changed into excited ions. The ions are mass-separated in mass spectrometer 52 and the ion intensities are detected by electron multiplier 67. The concentrations of the target elements are calculated from the ion intensities. Then, after cuvette 1 and tube 3 have been cooled, second to fifth valves 21, 22, 34A and 34B are closed. Another sample is injected into tube 3, and the same operations are repeated.

As has been described, cuvette 1, tube 3, and electrodes 5*a* and 5*b*, which contact the heated inert gas or the vaporized sample, are coated with a metal oxide film or a metal nitride film having a high melting point. Therefore, neither electrode 5*a* nor electrode 5*b* reacts with U or Th contained in the sample dropped into tube 3 to produce carbide, though they are made of graphite. Also, since annular grooves 27 are formed in the inner surface of cuvette 1 or cylindrical tube 3, sample 26 is prevented from moving within cuvette 1 or tube 3, or flowing out of cuvette 1 or tube 3. Also, heater $33_1$ is mounted on connecting tube $32_1$, and tube $32_1$ is heated during the analysis of the sample. This reduces the possibility that the vaporized sample gas flowing through tube $32_1$ is condensed and adsorbed to tube $32_1$. Accordingly, a trace U or Th contained in the sample can be fast analyzed with high accuracy by means of conductively coupled plasma mass spectrometer 30.

The following experiments were performed, using a sample-introducing apparatus in which had cuvette 1, tube 3, and electrodes 5*a* and 5*b* coated with a metal oxide film or a metal nitride film having a high melting point. As a result a trace U or Th in the sample were analyzed with the high accuracy.

EMBODIMENT 1 -1

Use was made of electrodes 5*a* and 5*b* made of graphite, cuvette 1 made of graphite and having an outer diameter of 8 mm, an inner diameter of 6 mm, a length of 28 mm and a sample injecting hole of 2 mmϕ center, and cylindrical tube 3 made of high-purity tantalum and having an outer diameter of 5.5 mm, an inner diameter of 4.5 mm, a length of 26 mm and the sample injecting hole of 2 mmϕ center. Electrodes 5*a* and 5*b*, cuvette 1 and cylindrical tube 3 had a part which contacted heated inert gas or vaporized sample and which was coated with a tantalum nitride film having a thickness of about 0.5 μm. The tantalum nitride film had been coated by depositing an organic tantalum compound on the part of each component and then calcinizing it in a nitrogen atmosphere.

COMPARATIVE EXAMPLE 1 -1

Except that cylindrical tube made of tantalum was not used, and the electrodes and the cuvette were not coated with a tantalum nitride film, a sample-introducing apparatus was assembled to have the same configuration as embodiment 1-1.

COMPARATIVE EXAMPLE 1 -2

A sample-introducing apparatus was assembled which was identical to embodiment 1 -1 except that the electrodes, the cuvette and the cylindrical made of the tantalum were not coated with a tantalum nitride film.

Then, using the sample-introducing apparatuses of embodiment 1 -1 and comparative examples 1 -1 and 1 -2 were used in combination with an inductively coupled plasma mass spectrometer to measure the ion intensity of sample (10 μl) having the uranium standard solution 100 pg/ml and 0 pg/ml under the following condition. The carrier gas used in the sample-introducing apparatuses: argon supplied at 4.0 l/min.

The sample was dried at 150° C for 30 sec. The sample was ashed at 1000° C for 30 sec. It was vaporized in the sample-introducing apparatuses at 2800° C, for 7 sec. The frequency of the high frequency source in the plasma torch was 27,12 MHz. The high frequency output power of the high frequency power source in the plasma touch was introduced 1.3 KW. The cooling gas was into the plasma torch at 15 l/min. The plasma gas was supplied into the plasma touch at 0.8 l/min.

As a result, this embodiment 1 -1 determined that the intensity of the sample ion in uranium standard solution 100 pg/ml was 250, and the intensity of the sample ion in uranium standard solution 0 pg/ml was 5. Comparative example 1 -1 determined that the intensity of the sample ion having uranium standard solution 100 pg/ml was 6, and the intensity of the sample ion having uranium standard solution 0 pg/ml was 2. Since cuvette 1 was made of graphite, uranium was made into carbide and could not be not detected. Comparative 1 -2 determined that the intensity of the sample ion having uranium standard solution 100 pg/ml was 280, and the intensity of the sample ion having uranium standard solution 0 pg/ml was 42. Since the cylindrical tube was not coated with a tantalum nitride film, the ion intensity of uranium was measured even though the sample is the standard solution 0 pg/ml, due to the mixing of the vaporized uranium.

EMBODIMENT 1 -2

Use was made of electrodes 5*a* and 5*b* made of graphite, cuvette 1 made of graphite and having an outer diameter of 8 mm, an inner diameter of 6 mm, a length of 28 mm, and one sample injecting hole of 2 mmϕ center; and cylindrical tube 3 made of tungsten of the high purity, and having an outer diameter of 5.5 mm, an inner diameter of 4.5 mm, a length of 26 mm, and one sample injecting hole of 2 mmϕ center. Electrodes 5*a* and 5*b*, cuvette 1 and cylindrical tube 3 had a part which contacted heated inert gas or vaporized sample and which was coated with a tungsten nitride film having a thickness of about 0.5 μm. The tungsten nitride film had been coated in a nitrogen atmosphere by coating an organic tungsten compound on said part of each component and thereafter calcinizing it.

COMPARATIVE EXAMPLE 1 -3

A sample-introducing apparatus was assembled which was identical to embodiment 1 -2 except that the cylindrical tube made of the tungsten was not used, and the electrodes and the cuvette were not coated by the tungsten nitride film.

COMPARATIVE EXAMPLE 1 -4

A sample-introducing apparatus was assembled which was identical to embodiment 1 -2 except that the electrode, the cuvette and the cylindrical tube made of the tungsten are coated by the tungsten nitride film. The sample-introducing apparatuses of embodiment 1 -2 and comparative example 1 -3 and 1 -4 were used, in combination with inductively coupled plasma mass spectrometer, to measure the ion intensity under the same condition as in embodiment 1 -1 except that sample (10 μl) of the thorium standard solution 100 pg/ml, and sample (10 μl) having the same standard solution 0 pg/ml were ashed at 600° C for 30 sec. As a result, this embodiment 1 -2 determined that the intensity of the sample ion having the thorium standard solution 100 pg/ml was 240, and the intensity of the sample ion having the same standard solution 0 pg/ml was 7. Comparative example 1 -3 determined that the intensity of the sample ion having the thorium standard solution 100 pg/ml was 4, and the intensity of the sample ion having the thorium standard solution 0 pg/ml was 2. Since the cuvette was made of the graphite, the thorium was made into carbide and could not be detected. Comparative 1 -4 determined that the intensity of the sample ion having the thorium standard solution 100 pg/ml was 280, and the intensity of the sample ion having the same standard solution 0 pg/ml was 52. Since cylindrical tube made of tungsten was not coated with a tungsten nitride film, the ion intensity of the thorium was measured even though the sample is the standard solution 0 pg/ml, due to the mixing of the vaporized thorium.

As is evident from the above, the sample-introducing apparatuses of embodiment 1 enhanced the detecting sensitivity of the U or the Th, about 100 times, comparing with the general inductively coupled plasma mass spectrometry; and about 10 times, comparing with the inductively coupled plasma mass spectrometry used jointly with a conventional vaporizing method.

Further, the sample-introducing apparatuses of embodiment 1 can be used in inductively coupled plasma emission spectrometer, and can attain the enhancement of the detecting intensity by about 10 times, comparing with the inductively coupled plasma emission spectrometry used jointly with the conventional vaporizing method.

In embodiments 1 described above, those surfaces of the cuvette and the electrodes which contacted the heated insert gas or the vaporized sample gas, were coated with a metal oxide film or a metal nitride film, either having a high melting point. Even when the basic material of the cuvette etc. was graphite, the U or the Th in the sample to be analyzed did not react with the graphite to produce carbide. As a result, the ionization efficient can be greatly enhanced, while the problem of the memory effect is resolved.

On the other hand, if the heat-resisting metal is used as the basic material of the cuvette etc., it can prevent U or Th contained as the impurity in the heat-resisting metal from evaporating owing to the metal oxide film or the metal nitride film having a high melting point. Furthermore, because the start of vaporization of U or Th in the heat-resisting metal occurs after the vaporization of U or Th in the sample, owing to the metal oxide film or the metal nitride film, the ion spectrum by U or Th in the sample and the ion spectrum by U or Th in the heat-resisting metal (the basic material) can be separated by the time. According to the present invention, the inductively coupled plasma mass spectrometer allows trace U or Th in the sample to be analyzed at high sensitivity and with high accuracy. Also, the present invention applies to the structure wherein the cuvette is made of graphite and the heat-resistant tube coated with a metal oxide film or a metal nitride film having a high melting point is fitted in the cuvette. Hence, the inductively coupled plasma mass spectrometer can readily analyze a trace U or Th in the sample at high sensitivity and with high accuracy, while the miniature of the vaporization space in the sample introducing apparatus may be accomplished.

For example, if the cuvette is made of the heat-resisting metal, the vaporization space of the sample-introducing apparatus must be large in light of the necessity of the adiabatic, since the heat-resisting metal has the good thermal conductivity. If the cuvette is made of graphite superior in the adiabatic, the vaporization space can be reduced. In this case, since the cuvette as well as the electrode are made of graphite, the space may still more be miniaturized.

EMBODIMENT 2

The sample introducing apparatus of embodiment 2 is characterized in that the surface of cuvette 1, the surface of tube 3, and the surfaces of electrodes 5*a* and 5*b*, which contact the heated inert gas or the vaporized sample gas, are coated with a two-layer film which consists of a metal carbide film of a high melting point and a metal oxide film or metal nitride film of a high melting point, formed one upon the other.

If for example, graphite is used as the basic material of cuvette 1 and electrodes 5*a* and 5*b*, during the vaporization of the sample U or the Th in the sample 26 dropped in tube 3 can be prevented from reacting with the graphite to produce carbide.

The following experiments were conducted, using a inductively coupled plasma mass spectrometer, along with the sample-introducing apparatus of embodiment 2 of the present invention. It was found that this apparatus detected trace U or Th in samples with high accuracy.

EMBODIMENT 2 -1

Use was made of electrodes 5*a* and 5*b* made of graphite, cuvette 1 made of graphite and having an outer diameter of 8 mm, an inner diameter of 6 mm, a length of 28 mm and one sample injecting hole of 2 mmϕ center, and cylindrical tube 3 made of high purity tantalum and having an outer diameter of 5.5 mm, an inner diameter 4.5 mm, a length of 28 mm and one sample injecting hole of 2 mmϕ center. Also, electrodes 5*a* and 5*b*, cuvette 1 and cylindrical tube 3 had a part which contacted heated inert gas and vaporized sample and was coated with a tantalum carbide film having a thickness of about 0.3 μm. The tantalum carbide film had been formed by depositing an organic tantalum compound on each of the components and then calcinizing it under in an argon gas atmosphere. A tantalum nitride film having a thickness of about 0.2 μm formed on the tantalum carbide film, by depositing an organic tantalum compound and thereafter calcinizing it in a nitrogen atmosphere.

COMPARATIVE EXAMPLE 2 -1

A sample-introducing apparatus was assembled which was identical to embodiment 2 -1, except that the cylindrical tube made of the tantalum was not used and also the electrode and the cuvette were not coated with a tantalum carbide film or a tantalum nitride film.

COMPARATIVE EXAMPLE 2 -2

A sample-introducing apparatus was assembled which is identical to embodiment 2 -1, except that the electrode, the cuvette and the cylindrical tube made of the tantalum were not coated with a tantalum carbide film or a tantalum nitride film.

Then, using the sample-introducing apparatuses of embodiments 2 -1 and comparative examples 2 -1 and 2 -2 along with the inductively coupled plasma mass spectrometer, the ion intensity in connection with sample (10 μl) of the uranium standard solution 100 pg/ml and sample (10 μl) of the same standard solution 0 pg/ml was measured under the same condition as embodiment 1 -1. This embodiment 2 -1 determined that the ion intensity of the sample having the uranium standard solution 100 pg/ml was 250, and the ion intensity of the sample having the same in the same standard solution 0 pg/ml was 2. Comparative example 2 -1 determined that the ion intensity of the sample having the uranium standard solution 100 pg/ml was 6, and the ion intensity of the sample having the uranium standard solution 0 pg/ml was 2. Since cuvette 1 was made of graphite the uranium was made into carbide and could not be detected. Comparative Example 2 -2 determined that the ion intensity of the sample having the uranium standard solution 100 pg/ml was 280, and the ion intensity of the sample having the uranium standard solution 0 pg/ml was 42. Since the tantalum nitride film or the tantalum carbide film was not coated, the ion intensity of the uranium was measured even though the sample is the standard solution 0 pg/ml, due to the mixing of the vaporized uranium in the cylindrical tube made of tantalum.

EMBODIMENT 2 -2

Use was made of electrodes 5*a* and 5*b* made of graphite, cuvette 1 made of graphite and having an outer diameter of 8 mm, an inner diameter of 6 mm, a length of 28 mm and one sample injecting hole of 2 mmϕ center, and cylindrical tube 3 made of high purity tungsten and having an outer diameter of 5.5 mm, an inner diameter of 4.5 mm, a length of 26 mm and one sample injecting hole of 2 mmϕ center. Electrodes 5*a* and 5*b*, cuvette 1 and cylindrical tube 3 had a part which contacted the heated inert gas or vaporized sample and was coated with a tungsten nitride film having a thickness of about 0.3 μm and also a tungsten nitride film having a thickness of 0.2 μm.

COMPARATIVE EXAMPLE 2 -3

A sample-introducing apparatus was assembled which was similar to embodiment 2 -2, except that a cylindrical tube made of tungsten was not used, and also the electrodes and the cuvette were not coated with a tungsten carbide film or a tungsten nitride film.

COMPARATIVE EXAMPLE 2 -4

A sample-introducing apparatus was assembled which was identical to embodiment 2 -2, except that the cuvette and the cylindrical tube made of tungsten is not coated by the tungsten carbide film or the tungsten nitride film.

Then, using the sample-introducing apparatuses of embodiment 2 -2 and comparative example 2 -3 and 2 -4, along with an inductively coupled plasma mass spectrometer, the ion intensity was measured under the same condition as by said embodiment 1 -1, except that the carbide condition with respect to the sample 10 μl of the thorium standard solution 100 pg/ml and the sample 10 μl of the same standard solution 0 pg/ml is set at 600° C for 30 sec. This embodiment 2 -2 determined that the ion intensity of the sample having the thorium standard solution 100 pg/ml was 240, and the ion intensity of the sample having the same standard solution 0 pg/ml was 2. Comparative example 2 -3 determined that the ion intensity of the sample having in the thorium standard solution 100 pg/ml was 4, and the ion intensity of the sample having the same standard solution 0 pg/ml is 2. Since the cuvette was made of graphite, the thorium was made into carbide and could not be detected. Also, comparative embodiment 2 -4 determined that the ion intensity of the sample having the thorium standard solution 100 pg/l was 280, and the ion intensity of the sample having the same standard solution 0 pg/ml was 52. Since the cylindrical tube was made of tungsten and not coated with a tungsten carbide film or a tungsten nitride film, the intensity of the thorium ion was measured even though the sample was the standard solution 0 pg/ml, due to the mixing of the thorium vaporized in this tube.

As is evident from the above, the sample-introducing apparatus of this embodiment 2 can enhance the detecting sensitivity of U or Th about 200 times, comparing with the general inductively coupled plasma mass spectrometry; and about 20 times, comparing with the inductively coupled plasma mass spectrometry used jointly with a conventional vaporizing method. Also, this embodiment 2 can be used in combination with inductively coupled plasma emission spectrometer, and can attain the enhancement of the detecting intensity by about 20 times comparing with the inductively coupled plasma emission spectrometry used jointly with the conventional vaporizing method.

As has been described above, the cuvette and the electrode, which contact the heated gas or the vaporized sample gas, are coated with a metal carbide and a metal oxide film or a metal nitride film having a high melting point. Therefore, even if the graphite is used as the basic material of the cuvette etc., U or Th in the sample to be analyzed does not react with the graphite to produce carbide. As a result, the ionization efficiency can be greatly enhanced, while the problem of the memory effect is resolved. Also, since the cuvette and the electrode, which contact with heated inert gas or the vaporized sample gas, are coated with a metal oxide film or a metal nitride film having a high melting point, the close adhesion can be enhanced greatly, compared with the case where the oxide film or the like is directly coated on the cuvette. On the other hand, if a heat-resisting metal is used as the basic material of the cuvette, a metal carbide film having a high melting point and a high gas impermeability prevents U or Th contained as an impurity in the heat-resisting metal from vaporizing. Furthermore, since the vaporization of U or Th starts after the vaporization of U or Th contained in the sample, due to the metal oxide film or the metal nitride film having a high melting point, the ion spectrum by U or Th contained in the sample and the ion spectrum by U or Th contained in the heat-resisting metal used as the basic material can be separated by the time. Also, since the metal oxide film or the metal nitride film, either having a high melting point and the metal carbide film having a high melting point are coated on the cuvette made of the heat-resisting metal, the heat-resistance can be enhanced greatly, comparing with the case where the oxide film is directly coated on the cuvette.

Further, since the cuvette is made of the graphite, and the high melting metal tube coated with a two-layer film consisting of metal carbide film and a metal oxide film, either having a the high melting point, is inserted into the cuvette, the inductively coupled plasma mass spectrometer can rapidly analyze a trace U or Th in the sample with high sensitivity and high accuracy, while the vaporization space in the sample-introducing apparatus can be reduced.

The following experiments were conducted, using a inductively coupled plasma mass spectrometer, along wherein a sample-introducing apparatus at least one groove is formed in the inner surface of cuvette 1 or in the inner surface of tube 3, and communicating with the sample injecting hole. Then, it was found that the mass spectrometer measured with good accuracy.

EMBODIMENT 3 -1

Use was made of electrodes 5*a* and 5*b* made of graphite, cuvette 1 made of graphite and having an outer diameter of 8 mm, an inner diameter of 6 mm, a length of 28 mm and one sample injecting hole of 2 mmϕ center, and cylindrical tube 3 made of high purity tungsten and having an outer diameter of 5.5 mm, an inner diameter of 4.5 mm, a length of 26 mm and the sample injecting hole of 2 mmϕ center. Also, electrodes 5*a* and 5*b*, cuvette 1 and cylindrical tube 3 had a part, which contacted with heated inert gas and vaporized sample and, were coated with a tungsten nitride film having a thickness of about 20 μm. The tungsten nitride film had been formed by depositing an organic tungsten compound on each of the components and then calcinizing it in a nitrogen gas atmosphere. One V-groove 27 having a width and depth of about 10 μm was formed in that part of the inner surface of tube 3 which is close to sample injecting hole 4 made in cylindrical tube 3. This fine groove 27 had been formed by mechanically scratching the tungsten nitride film on tube 3 by means of a jig made of high purity tungsten and having a sharp front end. Thereafter, tube 3 was heated at the high temperature of 2900° C in an argon gas flow.

COMPARATIVE EXAMPLE 3 -1

A sample-introducing apparatus was assembled which was similar to embodiment 3 -1, except that the fine grooves were not formed in the inner surface of the cylindrical tube made of the tungsten and coated with the tungsten nitride film.

COMPARATIVE EXAMPLE 3 -2

A sample-introducing apparatus was assembled which was identical to embodiment 3 -1, except that the electrode, the cuvette and the cylindrical tube made of the tungsten were not coated by the tungsten nitride film and also the fine grooves were not formed on the inner surface of the tube.

Then, using the sample introducing apparatuses of this embodiment 3 -1 and comparative example 3 -1 and 3 -2, along with an inductively coupled plasma mass spectrometer, the ion intensity was measured ten times under the following condition, with respect to the sample (10 μl) of the uranium standard solution 100 pg/ml and the sample (10 μl) of the same standard solution 0 pg/ml. The carrier gas, i.e., argon gas, was supplied into the sample-introducing apparatus at 4.0 l/min. The sample was dried in the sample introducing apparatus at 150° C for 30 sec. The sample was then ashed in the sample introducing apparatus at 1000° C for 30 sec. It was vaporized in the sample introducing apparatus at 2800° C for 7 sec. The frequency of the high frequency power source in the plasma torch was 27.12 MHz. The high frequency output power of the high frequency power source was 1.3 KW. The cooling gas was supplied into the plasma torch at 15 l/min. The plasma gas was supplied into the plasma torch at 0.8 l/min.

As a result, this embodiment 3 -1 determined that the average ion intensity of the sample having the uranium standard solution 100 pg/ml was 520, (the accuracy: ±7%), the average ion intensity of the sample having the uranium standard solution 0 pg/ml was 8 (the accuracy: ±6%). Comparative example 3 -1 determined that the average ion intensity of the sample having the uranium standard solution 100 pg/ml was 390 (the accuracy: ±15%), and the average ion intensity of the sample having the uranium standard solution 0 pg/ml was 8 (the accuracy: ±6%). Since grooves were not formed in the inner surface of the cylindrical tube, and the sample was moved from the predetermined position (directly below the sample injecting hole) on the inner surface of the tube, inevitably changing the temperature condition during the vaporization, the ion intensity of the uranium was reduced, degrading the accuracy. Comparative example 3 -2 determined that the average ion intensity of the sample having the uranium solution 100 pg/ml was 310 (the accuracy: ±8%). and the average ion intensity of the sample having the same standard solution 0 pg/ml was 45 (the accuracy: ±7%). Even though the sample was the standard solution 0 pg/ml, the ion intensity of the uranium could be measured due to the mixing of the vaporized uranium in the cylindrical tube made of the tungsten, on which the tungsten nitride film is not coated.

EMBODIMENT 3 -2

Use was made of electrodes 5*a* and 5*b* made of graphite, cuvette 1 made of graphite and having an outer diameter of 8 mm, an inner diameter of 6 mm, a length of 28 mm and one sample injecting hole of 2 mmϕ center, and cylindrical tube 3 made of high purity tantalum and having an outer diameter of 5.5 mm, an inner diameter of 4.5 mm, a length of 26 mm and one sample injecting hole of 2 mmϕ center. Three V-grooves 27 having a depth and width of about 10 μm were formed in the inner surface of that portion of tube 3, which had a length of 500 μm and in while sample injecting hole 4 was formed. Grooves 27 had been formed by mechanically scratching the inner surface of the tube by means of a jig made of the high purity tantalum and having a sharp front end. Thereafter, tube 3 was heated at high temperature of 2900° C in an argon gas flows.

COMPARATIVE EXAMPLE 3 -3

A sample-introducing apparatus was assembled which was similar to embodiment 3 -2, except that grooves were not formed in the inner surface of the cylindrical tube made of the tantalum.

Using the sample-introducing apparatuses of embodiment 3 -2 and comparative example 3 -3, along with an inductively coupled plasma mass spectrometer, the ion intensity was measured ten times under the same condition as in embodiment 3 -1, except that the ash condition to the sample (10 μl) of the europium standard solution 100 pg/ml and the sample (10 μl) of the same standard solution 0 pg/ml was set at 1100° C for 30 sec. Embodiment 3 -2 determined that the average ion intensity of the sample having the europium standard solution 100 pg/ml was 470 (the accuracy: ±6%), and the average ion intensity of the sample having europium standard solution 0 pg/ml was 3 (the accuracy: ±5%). Comparative example 3 -3 determined that the average ion intensity of the sample having the europium standard solution 100 pg/ml was 380 (the accuracy: ±14%), and the average ion intensity of the sample having the europium standard solution 0 pg/ml was 3 (the accuracy: ±5%). Since grooves were not formed on the inner surface of the cylindrical tube, and the sample was inevitably moved form the predetermined position on the inner surface of the tube (directly below the sample injecting hole), thus changing the temperature condition during the vaporization, the ion intensity of the europium was reduced, and the accuracy was degraded.

As can be evident from the above, the sample-introducing apparatus of embodiment 3 greatly enhanced the analyzing accuracy and sensitivity in measuring the uranium and the europium, comparing with the inductively coupled plasma mass spectrometer used jointly with the conventional vaporization method. The sample-introducing apparatus of embodiments 3 can be used in combination with an inductively coupled plasma emission spectrometer, and can greatly enhance the analyzing accuracy and sensitivity, comparing with the inductively coupled plasma emission spectrometry used jointly with the conventional vaporization method.

EMBODIMENT 4

Use was made of electrodes 5*a* and 5*b* made of graphite, and cuvette 1 made of graphite and having an outer diameter of 8 mm, an inner diameter of 6 mm, a length of 28 mm and one sample injecting hole of 2 mmϕ center. Also, no cylindrical tubes were inserted into the cuvette, one V-groove 27 having a width and depth of about 10 μm was formed in the inner surface in which sample injecting hole 2 had been made. This groove 27 was formed by mechanically scratching the inner surface of the cuvette by means of a jig made of high purity tantalum and having a sharp front end. Thereafter, the cuvette was heated at high temperature of 2900° C in an argon gas flow.

COMPARATIVE EXAMPLE 4

A sample-introducing apparatus was assembled which was identical to embodiment 4, except that no grooves were formed on the inner surface of the cuvette made of the graphite. Then, using the sample-introducing apparatuses of this embodiment 4 and comparative example 4, along with an inductively coupled plasma mass spectrometer, the ash condition with respect to the the ion intensity was measured ten times under the same condition as in embodiment 3 -1, except that the ash condition with respect to the sample 10 μl of the copper standard solution 100 pg/ml and the sample 10 μl of the copper standard solution 0 pg/ml is set at 800° C for 30 sec. Embodiment 4 determined that the average ion intensity of the sample having the copper standard solution 100 pg/ml was 420 (the accuracy: ±7%), and the average ion intensity of the sample having the copper standard solution 0 pg/ml was 6 (the accuracy: ±6%). Comparative example 4 determined that the average ion intensity of the sample having the copper standard solution 100 pg/ml was 370 (the accuracy: ±11%), and the average ion intensity of the sample having the copper standard solution 0 g/ml was 6 (the accuracy: ±6%). Since no grooves were formed in the inner surface of the cuvette, and the sample 26 moved from the predetermined position (directly below the sample injecting hole) on the inner surface of the cuvette, inevitably changing the temperature condition during the vaporization, the copper ion intensity was reduced, and the accuracy was degraded.

According to this embodiment 4, the analyzing accuracy and sensitivity can be greatly enhanced in measuring the copper, comparing with the inductively coupled plasma mass spectrometry used jointly with the vaporization method. Also, the sample-introducing apparatus of this embodiment 4 can be used in the inductively coupled plasma emission spectrometer and can greatly enhance the analyzing accuracy and sensitivity, compared with the inductively coupled plasma emission spectrometry used jointly with a conventional vaporization method.

As described above, groove 27 was formed near injecting hole 4 of cylindrical tube 3 made of a metal having a high melting point. Thus, sample 26 is prevented from moving from groove 27. As a result, it is possible to always vaporize samples 26 under the same temperature condition. This enables the inductively coupled plasma mass spectrometer to analyze a trace elements in the sample with high accuracy or high sensitivity.

The following experiments were conducted, using a inductively coupled plasma mass spectrometer provided with the connecting tube. It was found that a trace elements in the sample was analyzed with good accuracy.

EMBODIMENT 5 -1

Use was made of electrodes 5*a* and 5*b* made of graphite, cuvette 1 made of graphite and having an outer diameter of 8 mm, an inner diameter of 6 mm, a length of 28 mm, and one sample injecting hole of 2 mmϕ center, and cylindrical tube 3 made of high purity tantalum and having an outer diameter of 5.5 mm, an inner diameter of 4.5 mm, a length of 26 mm and one sample injecting hole of 2 mmϕ center. Electrodes 5*a* and 5*b*, cuvette 1 and cylindrical tube 3 had a part, which contacted heated inert gas and vaporized sample, and was coated with a tantalum nitride film having the thickness of 0.5 μm. The tantalum nitride film was coated by depositing an organic tantalum compound on each component and thereafter calcinizing it in a nitrogen atmosphere. Also, connecting tube $\mathbf{32}_1$ made of the quartz glass (the length of 5 cm) and connecting quartz pipe 9*a* of the heating furnace and the plasma torch 28 (not shown) was heated to about 200° C by means of infrared heater $\mathbf{33}_1$.

COMPARATIVE EXAMPLE 5 -1

A sample-introducing apparatus was assembled which was identical to that of embodiment 5 -1, except that the connecting tube made of quartz glass was not heated and was maintained at the room temperature (about 25° C), and the length of each of the tube was 5 cm.

COMPARATIVE EXAMPLE 5 -2

A sample-introducing apparatus was assembled which was similar to that of embodiment 5 -1, except that the connecting tube made of quartz glass was is not heated up to about 200° C by means of the infrared heater and also the length of the tube was 20 cm.

COMPARATIVE EXAMPLE 5 -3

A sample-introducing apparatus was assembled which was similar to that of embodiment 5 -1, except that the connecting tube made of quartz glass was not heated and was maintained at the room temperature (about 25° C), and also the length of each of the tube was 20 cm.

Then, using the sample-introducing apparatuses of this embodiment 5 -1 and comparative example 5 -1, 5 -2, and 5 -3, along with an inductively coupled plasma mass spectrometer, the ion intensity with respect to the sample (10 μl) of the uranium standard solution 100 pg/ml and the sample (10 μl) of the uranium standard solution 0 pg/ml was measured under the following conditions.

The carrier gas, i.e., argon, was supplied into the sample introducing apparatus at 4.0 l/min. The sample was dried in the sample introducing apparatus at 150° C for 30 sec. The sample was ashed in the sample introducing apparatus at 1000° C for 30 sec. It was vaporized in the sample-introducing apparatus at 2800° C for 7 sec. The frequency of the high frequency power source in the plasma torch was 27.12 MHZ. The high frequency output power of the high frequency power source in the plasma touch was 1.3 KW. The cooling gas was supplied into the plasma torch at 15 l/min. The plasma gas was supplied into the plasma torch at 0.8 l/min.

This embodiment 5 -1 determined that the ion intensity of the sample having the uranium standard solution 100 pg/ml was 490, and the ion intensity of the sample having the uranium standard solution 0 pg/ml was 8. Comparative example 5 -1 determined that the ion intensity of the sample having the uranium standard solution 100 pg/ml was 74, and the ion intensity of the sample having the uranium standard solution 0 pg/ml was 7. Since the connecting tube was not heated, the vaporized uranium gas was adsorbed to the connecting tube and, the ion intensity of the uranium was reduced. Comparative example 5 -2 determined that the ion intensity of the sample having the uranium standard solution 100 pg/ml was 220, and the ion intensity of the sample having the uranium standard solution 0 pg/ml was 8. Since the length of the connecting tube is relative longer 20 cm, the vaporized uranium gas was diluted or the gas flowing was dispersed, or the gas was adsorbed to the connecting tube, and the uranium ion was reduced. Comparative example 5 -3 determined that the ion intensity of the sample having the uranium standard solution 100 pg/ml was 34, and the ion intensity of the sample having the uranium standard solution 0 pg/ml was 5. Since the connecting tube was not heated, and the length of the tube was relatively longer 20 cm, the vaporized uranium gas was adsorbed to the connecting tube or was diluted, or was dispersed. The ion intensity of the vaporized uranium was greatly reduced.

EMBODIMENT 5 -2

Use was made of electrodes 5*a* and 5*b* made of graphite, cuvette 1 made of graphite and having an outer diameter of 8 mm, an inner diameter of 6 mm, a length of 28 mm and one sample injection hole of 2 mmϕ center and cylindrical tube 3 made of high purity tungsten and having an outer diameter of 5.5 mm, an inner diameter of 4.5 mm, a length of 26 mm and one sample injecting hole of 2 mmϕ center. Electrodes 5*a* and 5*b*, cuvette 1 and cylindrical tube 3 had a part, which contracted heated inert gas and vaporized sample gas, and was coated with a tungsten nitride film having a thickness of about 0.5 μm. The tungsten nitride film was formed by coating an organic tungsten compound on each component and thereafter calcinizing in a nitrogen atmosphere. On the other hand, connecting tube $\mathbf{32}_1$ (the having a length of 5 cm) made of quartz glass connecting the quartz pipe 9*a* of the heating furnace and the plasma torch 28 (not shown) was heated at about 200° C by means of infrared heater $\mathbf{33}_1$.

COMPARATIVE EXAMPLE 5 -4

A sample-introducing apparatus was assembled which was similar to embodiment 5 -2, except that the connecting tube made of quartz glass was not heated and was maintained at the room temperature (about 25° C), and also the length of each of the tube was 5 cm.

COMPARATIVE EXAMPLE 5 -5

A sample-introducing apparatus was assembled which was identical to embodiment 5 -2, except that the connecting tube made of quartz glass was heated at 200° C by means of an infrared heater, and also the length of each of tube was 20 cm.

COMPARATIVE EXAMPLE 5 -6

A sample-introducing apparatus was assembled which was similar to that of embodiment 5 -2, except that the connecting tube made of quartz glass was not heated, and also the length of each of the tube was 20 cm. Then, using the sample-introducing apparatuses of this embodiment 5 -2 and comparative example 5 -4, 5 -5 and 5 -6, along with an inductively coupled plasma mass spectrometer, the ion intensity was measured under the same condition as in embodiment 5 -1, except that the ash condition with respect to sample (10 μl) of the thorium standard solution 100 pg/ml and sample (10 μl) of the thorium standard solution 0 pg/ml is set at 600° C for 30 sec. Embodiment 5 -2 determined that the ion intensity of the sample having the thorium standard solution 100 pg/ml was 460, and the ion intensity of the sample having the thorium standard solution 0 pg/ml was 9. Comparative example 5 -4 determined that the ion intensity of the sample having the thorium standard solution 100 pg/ml was 65, and the ion intensity of the sample having the thorium standard solution 0 pg/ml was 10. Since the connecting tube was not heated, the vaporized thorium gas was adsorbed to be the connecting tube, inevitably reducing the ion intensity of the thorium. Comparative example 5 -5 determined that the ion intensity of the sample having the thorium standard solution 100 pg/ml was 210, and the ion intensity of the sample having the thorium standard solution 0 pg/ml was 9. Since the length of the connecting tube was relatively longer 20 cm, the vaporized thorium gas was diluted or adsorbed to the connecting tube, inevitably reducing the ion intensity of the thorium. Comparative example 5 -6 determined that the ion intensity of the sample having the thorium standard solution 100 pg/ml was 31, and the ion intensity of the sample having the thorium standard solution 0 pg/ml was 9. Since the length of the tube was a relative longer 20 cm, the vaporized thorium gas was adsorbed to the connecting tube or diluted, or dispersed. Therefore, the ion intensity of the thorium was greatly reduced.

As can be understood from the above, the sample-introducing apparatus of embodiment 5 can enhance the ion intensity of the uranium or the thorium, about 500 times comparing with the conventional inductively coupled plasma mass spectrometry, and about 10 times comparing with the inductively coupled plasma mass spectrometry used jointly with a conventional vaporization method. Also, the sample introducing apparatus of embodiment 5 can be used in the inductively coupled plasma emission spectrometer and can attain the enhancement of the detecting sensitivity up to about 10 times comparing with the inductively coupled plasma emission spectrometry used jointly with a conventional vaporization method.

EMBODIMENT 6

Use was made of electrodes 5*a* and 5*b* made of graphite, cuvette 1 made of graphite and having an outer diameter of 8 mm, an inner diameter of 6 mm, a length of 28 mm and sample injecting hole of 2 mmϕ center. No cylindrical tubes were used, and no coating was formed on electrodes 5*a* or 5*b*, or cuvette 1. Also connecting tube $\mathbf{32}_1$ (length: 5 cm) made of the quartz glass was heated at about 200° C by means of infrared heater $\mathbf{33}_1$.

COMPARATIVE EXAMPLE 6 -1

A sample-introducing apparatus was assembled which was identical to embodiment 6, except that the connecting tubes made of quartz glass was not heated and was maintained at the room temperature (25° C), and the length of each of tube was 5 cm.

COMPARATIVE EXAMPLE 6 -2

A sample-introducing apparatus was assembled which was identical to that of embodiment 6, except that the connecting tube made of quartz glass was heated at 200° C, and also the length of the each of tubes was 20 cm.

COMPARATIVE EXAMPLE 6 -3

A sample-introducing apparatus was assembled which was similar to that of embodiment 6, except that the connecting tube made of quartz glass was not heated and was maintained at the room temperature (about 25° C), and also the length of the each of tubes was 20 cm.

Then, using the sample introducing apparatuses of this embodiment 6 and comparative example 6 -1, 6 -2 and 6 -3, along with an inductively coupled plasma mass spectrometer, the ion intensity in connection with the sample (10 μl) of the aluminum standard solution 100 pg/ml and the sample (10 μl) of the aluminum standard solution 0 pg/ml was measured under the condition similar to that of embodiment 5-1. Embodiment 6 determined that the ion intensity of the sample having the aluminum standard solution 100 pg/ml was 380, and the ion intensity of the sample having the aluminum standard solution 0 pg/ml was 2. Comparative example 6 -1 determined that the ion intensity of the sample having the aluminum standard solution 100 pg/ml was 87, the ion intensity of the sample having the aluminum standard solution 0 pg/ml was 2. Since connecting tube was not heated, the vaporized aluminum gas was adsorbed to the connecting tube, and the ion intensity of the aluminum was reduced. Comparative example 6 -2 determined that the ion intensity of the sample having the aluminum standard solution 100 pg/ml was 190, and the ion intensity of the sample having the aluminum standard solution 0 ppg/ml was 2. Since the length of the tube was a relatively long 20 cm, the vaporized aluminum gas was diluted or dispersed, or the gas was adsorbed to the connecting tube, and the ion intensity of the aluminum is reduced. Comparative example 6 -3 determined that the ion intensity of the sample having the aluminum standard solution 100 pg/ml was 39, and the ion intensity of the sample having the aluminum standard solution 0 pg/ml was 2. Since connecting tube was not heated, and its length was relatively long 20 cm, the vaporized aluminum gas was adsorbed to the connecting tube or diluted, or dispersed, and the ion intensity of the aluminum was greatly reduced.

As is evident from the above, the sample-introducing apparatus of embodiment 6 can enhance the detecting sensitivity of the aluminum ion, about 500 times comparing with a conventional inductively coupled plasma mass spectrometry, and about 10 times comparing with the inductively coupled plasma mass spectrometry used jointly with a conventional vaporization method. Also, the sample introducing apparatus of this embodiment 6 can be used in combination with the inductively coupled plasma emission spectrometer, and can enhance the detecting sensitivity, about 10 times comparing with a conventional inductively coupled plasma emission spectrometry.

As described above the heating means surrounds the connecting portion between the cuvette and the plasma touch portion. Therefore, the temperature of the connecting portion can easily be raised, and the vaporized sample gas flowing through the connecting portion can be prevented from being condensed or adsorbed thereto. As a result, the efficiency of introducing the target elements into the plasma torch of the inductively coupled plasma mass spectrometer can greatly be increased, while trace elements in the sample can be analyzed with high sensitivity or high accuracy by means of the inductively coupled plasma mass spectrometer Also, it is possible to easily monitor, from outside the adsorption state of the sample gas in the connecting portion, since the connecting portion is made of a transparent and good acid-resistant material For example, when the sample gas is adsorbed to the connecting portion, the connecting portion is colored, and the condensation is attached to the connecting portion. Therefore, the adsorption can be recognized by naked eyes. Whenever the condensation is found, it is removed, whereby as a result, it is possible to analyze the sample, with no sample gas adsorbed.

Also, the vaporized sample gas can be prevented from being condensed on the connecting portion or absorbed thereto, or being dispersed or diluted.

Also, since a plurality of the portions connecting the cuvette and plasma touch portion are arranged parallel, and the members for changing the paths of the sample gas are installed on the coupling portion of said connecting portions, the sample gas can be flowed through other connecting portion if one connecting portion is contaminated by the adsorption of the sample gas, etc. Therefore, it is not necessary to remove, wash, connect or adjust the connecting portion. The analyzing operation is easily and continuously performed.

As described above, according to the present invention it is possible to provide the sample-introducing apparatus which enables an inductively coupled plasma mass spectrometer to analyze a trace U or Th in a sample with the high sensitivity or the high accuracy.

What is claimed is:

1. An apparatus for vaporizing a sample and introducing the vaporized sample into an inductively coupled plasma source mass spectrometer, comprising:

means for supplying an inert gas which transfers the vaporized sample;

a heater for generating a heat with an electrical power, which is provided with a film structure having an inner surface for defining a path through which the inert gas is passed and on which the sample is to be located, the film structure including a material for forming the inner surface, and essentially consisting of one selected from the group consisting of a metal oxide and a nitride; and an electrode structure for supporting the heater and supplying the electrical power to the heater.

2. An apparatus according to claim 1, wherein the heater and electrode structure essentially consists of a material selected from the group consisting of tantalum, tungsten, rhenium and zirconium.

3. An apparatus according to claim 1, wherein the inert gas is essentially consisted of the gas selected from the group consisting of argon, helium and a gas added with hydrogen.

4. An apparatus according to claim 1, wherein the film structure has a thickness within a range of 1 -10 μm.

5. An apparatus according to claim 1, wherein the metal oxide essentially consists of a material selected from the group consisting of tantalum oxide, tungsten oxide and zirconium oxide.

6. An apparatus according to claim 1, wherein the metal nitride essentially consists of a material selected from the group consisting of tantalum nitride, tungsten nitride, hafnium nitride, zirconium nitride and titanium nitride.

7. An apparatus according to claim 1, wherein the film structure includes a single film which essential consists of a material selected from the group consisting of metal oxide and metal nitride, and the heater has the inner surface coated by the single film.

8. An apparatus according to claim 1, wherein the electrode structure has an inner surface on which the film structure is formed, and the film structure essentially consists of a material selected from the group consisting of metal oxide and metal nitride.

9. An apparatus according to claim 8, wherein the metal oxide essentially consists of a material selected from the group consisting of tantalum oxide, tungsten oxide and zirconium oxide.

10. An apparatus according to claim 8, wherein the metal nitride essentially consists of a material selected from the group consisting of tantalum nitride, tungsten nitride, hafnium nitride, zirconium nitride and titanium nitride.

11. An apparatus according to claim 8, wherein the film structure includes a single film and the single film essentially consists of a material selected from the group consisting of metal oxide and metal nitride.

12. An apparatus according to claim 1, wherein the heater comprises a cylindrical cuvette having the inner surface on which the film structure is formed, and the film structure includes a single film essentially consisting of a material selected from a group consisting of metal oxide and metal nitride.

13. An apparatus according to claim 12, wherein the cylindrical cuvette essentially consists of graphite.

14. An apparatus according to claim 13, wherein the film structure includes a two-layered film, the surface of the heater being coated by a metal carbide film, and the carbide film being coated by one of a metal oxide film and a metal nitride film.

15. An apparatus according to claim 14, wherein the metal carbide film is essentially consisted of a material selected from the group consisting of tantalum carbide, tungsten carbide, hafnium carbide, zirconium carbide and titanium carbide.

16. An apparatus according to claim 1, wherein the heater comprises a cylindrical cuvette, and a metal tube and fitted in the cylindrical cuvette, the tube has the inner surface for defining the path, through which the inert gas is passed, the film structure is a two-layered film, the surface of the tube is coated by a metal carbide film, and the carbide film is coated by one of the metal oxide film and the metal nitride film.

17. An apparatus according to claim 16, wherein the metal carbide essentially consists of a material selected from the group consisting of tantalum carbide, tungsten carbide hafnium carbide, zirconium carbide and titanium carbide.

18. An apparatus according to claim 16, wherein the cylindrical cuvette essentially consists of graphite.

19. An apparatus according to claim 1, wherein the film structure includes a two-layered film, the surface of the electrode structure is coated by a metal carbide film and the carbide film is coated by one of the metal oxide film and the metal nitride film.

20. An apparatus according to claim 19, wherein the metal carbide film essentially consists of a material selected from the group consisting of tantalum carbide, tungsten carbide, hafnium carbide, zirconium carbide and titanium carbide.

21. An apparatus according to claim 1, wherein the heater has a sample introducing hole for introducing the sample into the inner surface of the film structure to the vaporization of the sample, and grooves coated by the film structure are formed on the inner surface facing the sample introducing hole.

22. An apparatus according to claim 21, wherein the film structure has a thickness within a range of 1 -10 μm.

23. An apparatus according to claim 1, further comprising:

a means defining at least one flowing path for supplying the vaporized sample and the inert gas carrying said vaporized sample to the inductively coupled plasma mass spectrometer; and a means for housing said means for defining said at least one flowing path.

24. An apparatus according to claim 23, wherein the means defining said at least one flowing path is made of a transparent material.

25. An apparatus according to claim 24, wherein the means for defining said at least one flowing path defines plural flowing paths for supplying the vaporized sample and the inert gas carrying said vaporized sample to the inductively coupled plasma mass spectrometer, and includes means for selecting one of said plural flowing paths.

26. A sample analyzing apparatus comprising:

a means supplying an inert gas for carrying a vaporized sample;

a heater for generating a heat with an electrical power, which is provided with a film structure having an inner surface for defining a path through which the inert gas is passed and on which the sample is to be located, the film structure including a material for forming the inner surface, and essentially consisting of one selected from the group consisting of metal oxide and metal nitride;

an electrode structure for supporting the heater and supplying the electrical power to the heater;

a means for ionizing the vaporized sample with a plasma into excited sample ions;

a means for introducing the sample ions; and a means for mass-separating the introduced sample ions and detecting the intensity of the introduced ions.

27. A sample analyzing apparatus according to claim 26, wherein said ionizing means includes means for generating the plasma.

28. An apparatus according to claim 26, wherein the heater and electrode structure essentially consist of a material selected from the group consisting of tantalum, tungsten, rhenium and zirconium.

29. An apparatus according to claim 26, wherein the inert gas is essentially consisted of a gas selected from the group consisting of argon, helium and a gas added with hydrogen.

30. An apparatus according to claim 26, wherein the film structure has the thickness within a range of 1 -10 μm.

31. An apparatus according to claim 26, wherein the metal oxide essentially consists of a material selected from the group consisting of tantalum oxide, tungsten oxide and zirconium oxide.

32. An apparatus according to claim 26, wherein the metal nitride essentially consists of a material selected from the group consisting of tantalum nitride, tungsten nitride, hafnium nitride, zirconium nitride and titanium nitride.

33. An apparatus according to claim 26, wherein the film structure includes a single film which essentially consists of a material selected from the group consisting of metal oxide and metal nitride, and the heater has the inner surface coated by the single film.

34. An apparatus according to claim 26, wherein the electrode structure has an inner surface on which the film structure is formed, and the film structure essentially consists of a material selected from the group consisting of metal oxide and metal nitride.

35. An apparatus according to claim 34, wherein the metal oxide essentially consists of a material selected from the group consisting of tantalum oxide, tungsten oxide and zirconium oxide.

36. An apparatus according to claim 34, wherein the metal nitride essentially consists of a material selected from the group consisting of tantalum nitride, tungsten nitride, hafnium nitride, zirconium nitride and titanium nitride.

37. An apparatus according to claim 34, wherein the film structure includes a single film and the single film essentially consists of a material selected from the group consisting of metal oxide and metal nitride.

38. An apparatus according to claim 26, wherein the heater comprises a cylindrical cuvette having the inner surface on which the film structure is formed, and the film structure includes a single film essentially consisting of a material selected from a group consisting of metal oxide and metal nitride.

39. An apparatus according to claim 38, wherein the cylindrical cuvette essentially consists of graphite.

40. An apparatus according to claim 38, wherein the film structure includes a two-layered film, the surface of the heater is coated by a metal carbide film, and the carbide film is coated by one of a metal oxide film and a metal nitride film.

41. An apparatus according to claim 40, wherein the metal carbide film essentially consisted of a material selected from the group consisting of tantalum carbide, tungsten carbide, hafnium carbide, zirconium carbide and titanium carbide.

42. An apparatus according to claim 26, wherein the heater comprises a cylindrical cuvette, and a metal tube having a high melting point and fitted in the cylindrical cuvette, the tube has the inner surface for defining the path, through which the inert gas is passed, the film structure is a two-layered film, the surface of the tube is coated by a metal carbide film, and the carbide film is coated by on of the metal oxide film and the metal nitride film.

43. An apparatus according to claim 42, wherein the metal carbide essentially consists of a material selected from the group consisting of tantalum carbide, tungsten carbide hafnium carbide, zirconium carbide and titanium carbide.

44. An apparatus according to claim 42, wherein the cylindrical cuvette essentially consists of graphite.

45. An apparatus according to claim 26, wherein the film structure includes two-layered film, the surface of the electrode structure being coated by a metal carbide film and the carbide film is coated by one of the metal oxide film and the metal nitride film.

46. An apparatus according to claim 45, wherein the metal carbide film essentially consists of a material selected from the group consisting of tantalum carbide, tungsten carbide, hafnium carbide, zirconium carbide and titanium carbide.

47. An apparatus according to claim 26, wherein the heater has a sample introducing hole for introducing the sample into the inner surface of the film structure to the vaporization of the sample, and grooves coated by the film structure are formed on the inner surface faced to the sample introducing hole.

48. An apparatus according to claim 47, wherein the film structure has a thickness within a range of 1 -10 μm.

49. An apparatus according to claim 26, further comprising:

a means defining at least one flowing path for supplying the vaporized sample and the inert gas carrying said vaporized sample to the inductively coupled plasma mass spectrometer; and a means for heating said means for defining said at least one flowing path.

50. An apparatus according to claim 49, wherein the means defining said at least one flowing path is made of a transparent material.

51. An apparatus according to claim 50, wherein the means defining said at least one flowing path defines plural paths for supplying the vaporized sample and the inert gas carrying said vaporized sample to the inductively coupled plasma mass spectrometer, and includes a means for selecting one of said plural flowing paths.

* * * * *